US007618239B2

(12) United States Patent
Hatsugai et al.

(10) Patent No.: US 7,618,239 B2
(45) Date of Patent: Nov. 17, 2009

(54) MULTI-BLADE FAN FOR AIR-COOLED ENGINE

(75) Inventors: Tsutomu Hatsugai, Wako (JP); Takahiro Ideguchi, Wako (JP); Yutaka Tabata, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 422 days.

(21) Appl. No.: 11/444,417

(22) Filed: Jun. 1, 2006

(65) Prior Publication Data

US 2006/0275123 A1 Dec. 7, 2006

(30) Foreign Application Priority Data

Jun. 2, 2005 (JP) ..... 2005-162891

(51) Int. Cl.
*F04D 29/30* (2006.01)

(52) U.S. Cl. ..... 416/185; 416/186 R; 416/189; 416/243; 416/223 B

(58) Field of Classification Search ..... 415/206; 416/185, 186 R, 189, 195, 223 B, 238, DIG. 2, 416/243
See application file for complete search history.

(56) References Cited

U.S. PATENT DOCUMENTS 5,964,576 A * 10/1999 Fujita et al. ..... 415/206
6,558,120 B2 * 5/2003 Kim et al. ..... 416/186 R
6,769,876 B2 * 8/2004 Sakai et al. ..... 415/206
7,179,050 B2 * 2/2007 Hopfensperger ..... 416/186 R
7,281,898 B2 * 10/2007 Baek et al. ..... 416/186 R
2003/0012649 A1 * 1/2003 Sakai et al. ..... 415/206

FOREIGN PATENT DOCUMENTS

JP 2001-271791 10/2001

* cited by examiner

*Primary Examiner*—Ninh H Nguyen
(74) *Attorney, Agent, or Firm*—Westerman, Hattori, Daniels & Adrian, LLP

(57) ABSTRACT

In a multi-blade fan for an air-cooled engine, by defining the inlet angle β1 and the angle β'2 to make the sum thereof less than 80° (preferably defining β1 as 32° and β'2 as 36°), the multi-blade fan achieves greater air volume than in the case where the sum is made 80° or greater, where β1 is the angle between the relative velocity direction and the peripheral direction on the inlet side of the blades, β2 is the angle between the relative velocity direction and the peripheral direction on the outlet side of the blades, and β'2 is the difference obtained by subtracting β2 from 180°. The number of blades can therefore be reduced to realize lower noise level while still maintaining the same air volume as the prior art multi-blade fan.

7 Claims, 11 Drawing Sheets

Related Art

Related Art

MULTI-BLADE FAN FOR AIR-COOLED ENGINE

FIELD OF THE INVENTION

This invention relates to a multi-blade fan for an air-cooled engine, particularly to a multi-blade fan for an air-cooled engine that cools an internal combustion engine with cooling air blown onto the engine by rotating an impeller having many forward-curved blades.

DESCRIPTION OF THE RELATED ART

Owing to its small size and large air volume, the multi-blade fan (sirocco fan) has come to be widely used as a fan for forcefully blowing cooling air onto an engine. The multi-blade fan is a kind of centrifugal fan that blows air by rotating an impeller having many forward-curved blades. An example of such a fan can be found in Japanese Laid-Open Patent Application No. 2001-271791.

SUMMARY OF THE INVENTION

While the multi-blade fan is characterized by small size and large air volume, it has a drawback in the point of being less efficient and noisier than the turbofan, another type of centrifugal fan. This led to the practice of lining the impeller cover with acoustic material or sound insulation material so as to reduce noise transmitted to the outside. Thus, the conventional approach to the noise problem has not focused on reducing the noise generated by the multi-blade fan but on adding members for suppressing propagation of the generated noise and, as such, has increased the number of components and raised cost.

Multi-blade fan noise consists of rotational noise at the blade-passage frequency and harmonics thereof, and broadband turbulence noise induced by vortices and the like. Since blade-passage frequency is equal to the number of blades multiplied by the speed of rotation, rotational noise can be lowered in frequency by reducing the number of blades. When rotational noise frequency is reduced (to below 1,000 Hz), the resulting modification of the A-weighted sound level has the effect of improving the auditory sensation, i.e., of reducing the noise level. As used in this specification, the term "noise level" means the sound pressure level measured using an A-weighted noise meter and is expressed in units of dB (A). The A-weighted noise level is obtained by weighting sound pressure level measurements (in units of dB) as a function of frequency to reflect the response of the human ear.

The disadvantage of reducing the number of blades is that it lowers air volume. Air volume can be increased by either raising the speed of rotation or expanding blade outer diameter. But raising the speed of rotation increases the frequency of the rotational noise, which makes it impossible to realize the A-weighted sound level effect of enhancing auditory sensation, while expanding the blade outer diameter is not practical because it deprives the multi-blade fan of its merit of compactness.

An object of this invention is therefore to overcome the foregoing drawbacks by providing a multi-blade fan for an air-cooled engine that achieves noise level reduction without lowering air volume.

In order to achieve the object, this invention provides a multi-blade fan having an impeller equipped with a plurality of blades attached to an air-cooled internal combustion engine to be rotated to blow air toward the engine to cool, comprising: an inlet angle $\beta 1$ defined to be an angle between a relative velocity direction and a peripheral direction on an inlet side of the blades, an outlet angle $\beta 2$ defined to be an angle between the relative velocity direction and the peripheral direction on an outlet side of the blades; and an angle $\beta' 2$ defined to be a difference obtained by subtracting the outlet angle $\beta 2$ from 180°; wherein a sum of the inlet angle $\beta 1$ and the angle $\beta' 2$ is made less than 80°.

BRIEF DESCRIPTION OF THE DRAWINGS

The above and other objects and advantages of the invention will be more apparent from the following description and drawings in which:

FIG. 1 is a side view showing a multi-blade fan for an air-cooled engine according to an embodiment of the invention together with the engine it is attached to;

DETAILED DESCRIPTION OF THE PREFERRED EMBODIMENT

A multi-blade fan for an air-cooled engine according to a preferred embodiment of the present invention will now be explained with reference to the attached drawings.

Figure 1:
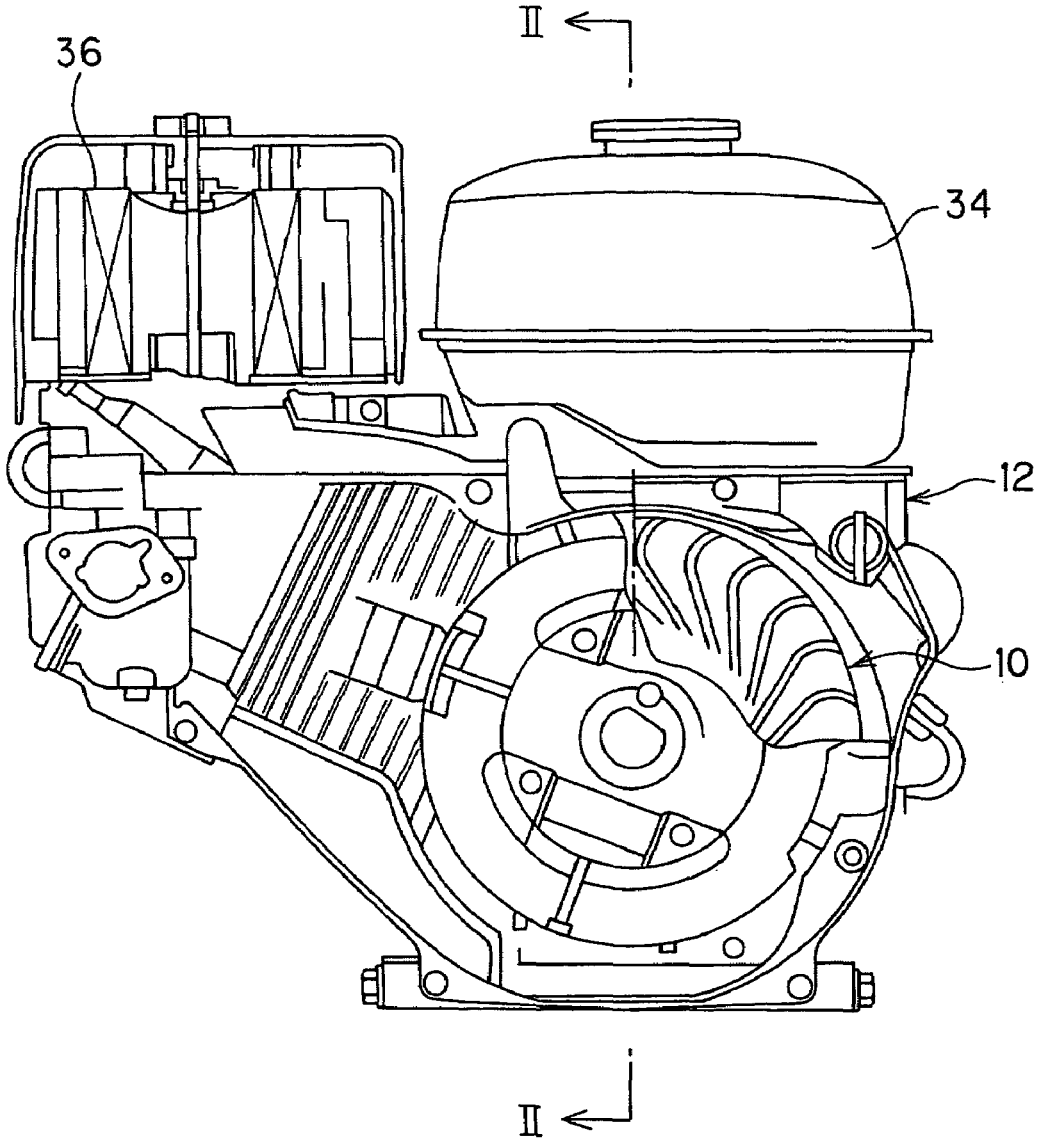

FIG. 1 is a side view showing the multi-blade fan for an air-cooled engine according to the preferred embodiment of the invention together with the engine it is attached to.

The reference numeral 10 in FIG. 1 designates the multi-blade fan for an air-cooled engine. The multi-blade fan 10 is attached to an air-cooled internal combustion engine 12. The engine 12 is a four-stroke, single-cylinder engine with a displacement of 196 cc.

Figure 2:
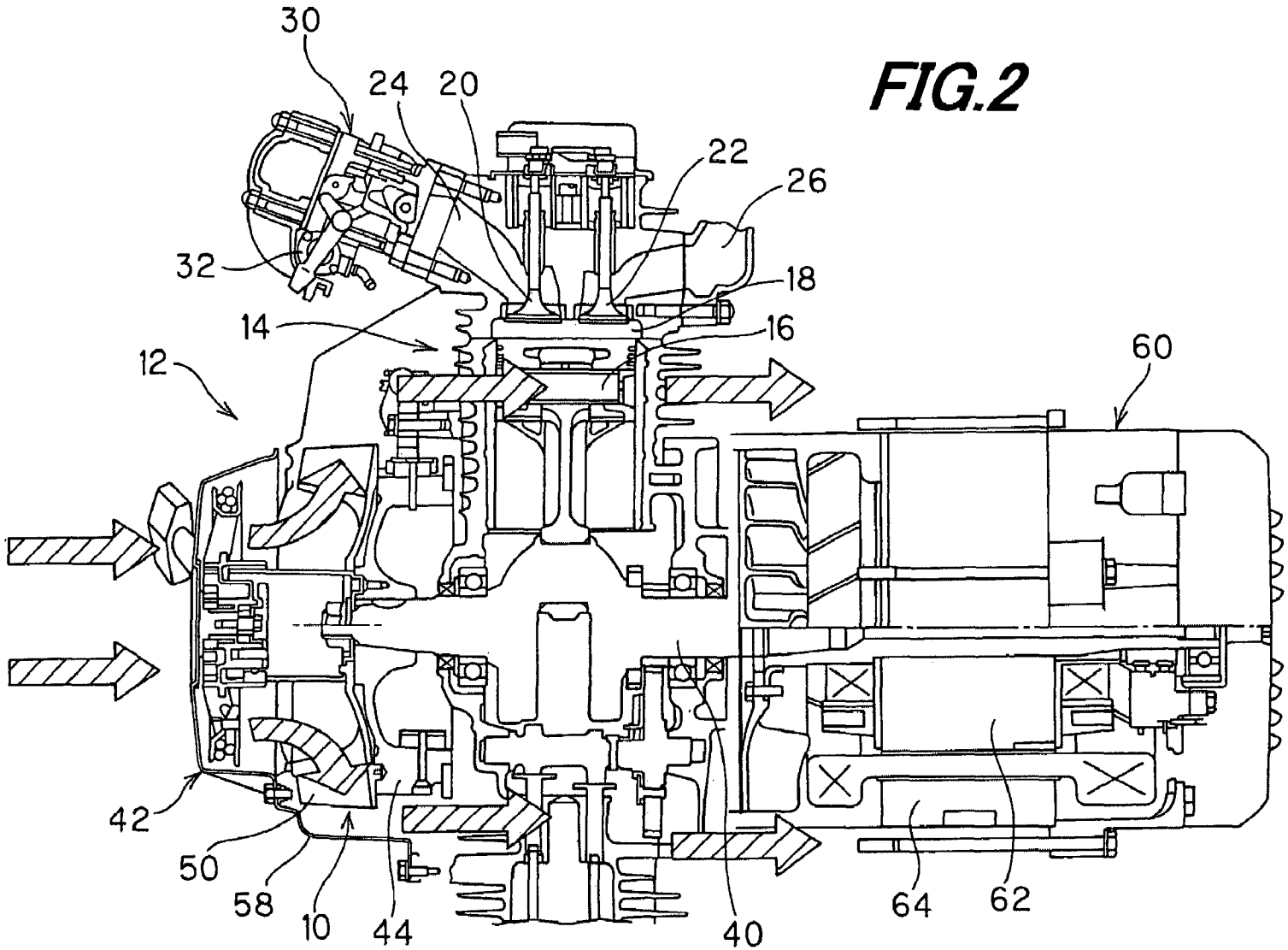
FIG. 2 is a sectional view taken along II-II in FIG. 1.

FIG. 2 is a sectional view taken along II-II in FIG. 1.

The engine 12 has a cylinder 14 accommodating a piston 16 that can reciprocate therein. An intake valve 20 and an exhaust valve 22 are provided to face into a combustion chamber 18 of the engine 10 for opening and closing communication of the combustion chamber 18 with an intake pipe 24 and an exhaust pipe 26.

A throttle body 30 is installed in the intake pipe 24. The throttle body 30 accommodates a throttle valve (not shown). A carburetor assembly 32 is integrally attached to the throttle body 30. The carburetor assembly 32 is connected to a fuel tank 34 (shown in FIG. 1) and produces an air-fuel mixture by jetting gasoline fuel into air drawn in at a rate determined by the opening of the throttle valve. The produced air-fuel mixture is drawn into the combustion chamber 18 through the intake valve 20. The intake pipe 24 is equipped upstream of the throttle body 30 with an air cleaner 36 (shown in FIG. 1).

The piston 16 is connected to a crankshaft 40. A recoil starter 42, the multi-blade fan 10 and a flywheel 44 are attached to one end of the crankshaft 40 in the order mentioned from the outside inward. The multi-blade fan 10 comprises an impeller 50 that rotates integrally with the crankshaft 40.

Figure 3:
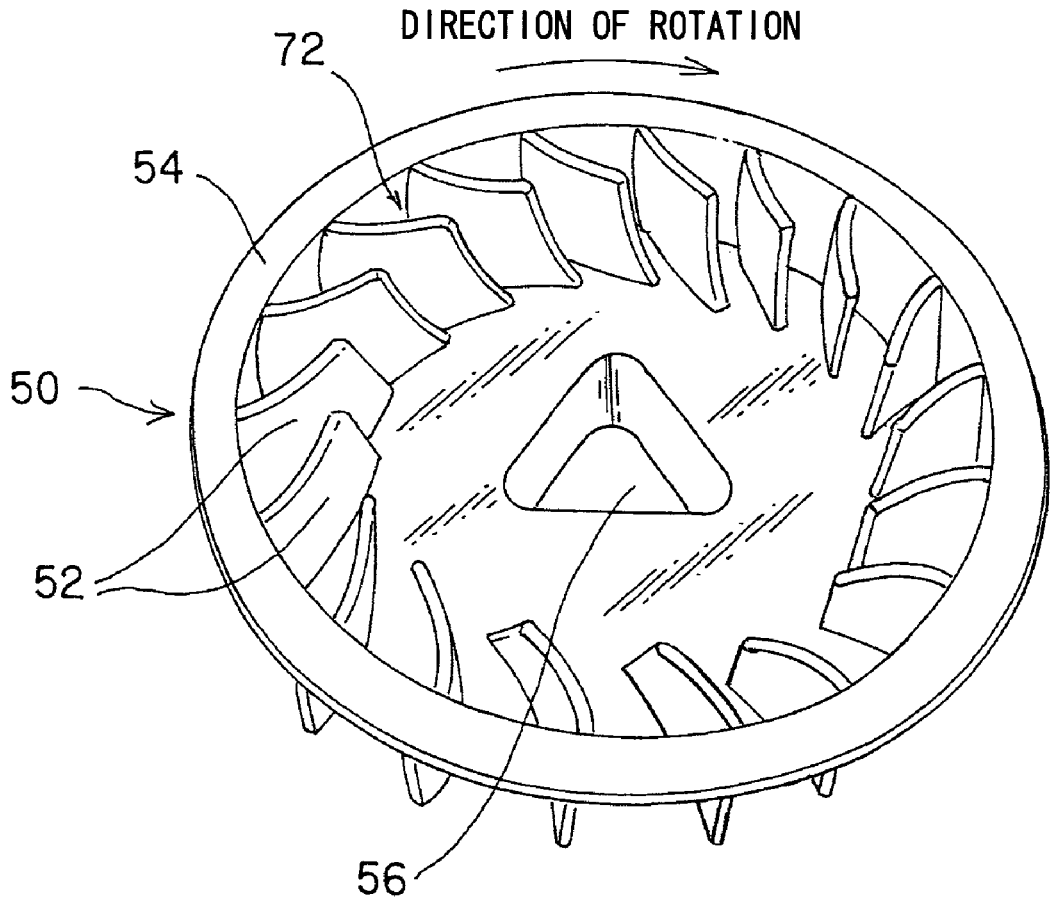
FIG. 3 is an enlarged perspective view of an impeller shown in FIG. 2.

FIG. 3 is an enlarged perspective view of the impeller 50 shown in FIG. 2.

The impeller 50 has many, more precisely 18 forward-curved blades 52. It is also equipped with an annular roof 54 formed continuously along the blades 52. The reference numeral 56 designates a hole for fitting on the crankshaft 40.

The explanation of FIG. 2 will be continued. The periphery of the impeller 50 is enclosed by a cover 58. An alternator 60 is attached to the other end of the crankshaft 40. The alternator 60 is equipped with a rotor 62 and a stator 64. The rotor 62 is directly attached to the crankshaft 40 and rotates integrally therewith.

When the engine 12 is in operation, the rotor 62 of the alternator 60 rotates together with the crankshaft 40 to generate alternating current. The frequency of the alternating current is set to 50 Hz or 60 Hz (the two frequencies of electricity supplied to homes in different areas of Japan). The speed of the engine 12 is therefore set to 3,000 rpm (when generating 50 Hz current) and to 3,600 rpm (60 Hz current). The engine 12 and alternator 60 thus constitute a generator system that generates alternating current at prescribed frequencies. The alternating current generated by the alternator 60 is supplied to electrical equipment (not shown) as operating power.

The impeller 50 rotates together with the crankshaft 40. Therefore, as indicated by the arrows, air is blown toward the engine 12, thereby cooling the engine 12.

The structure of the impeller 50 will be explained.

Figure 4:
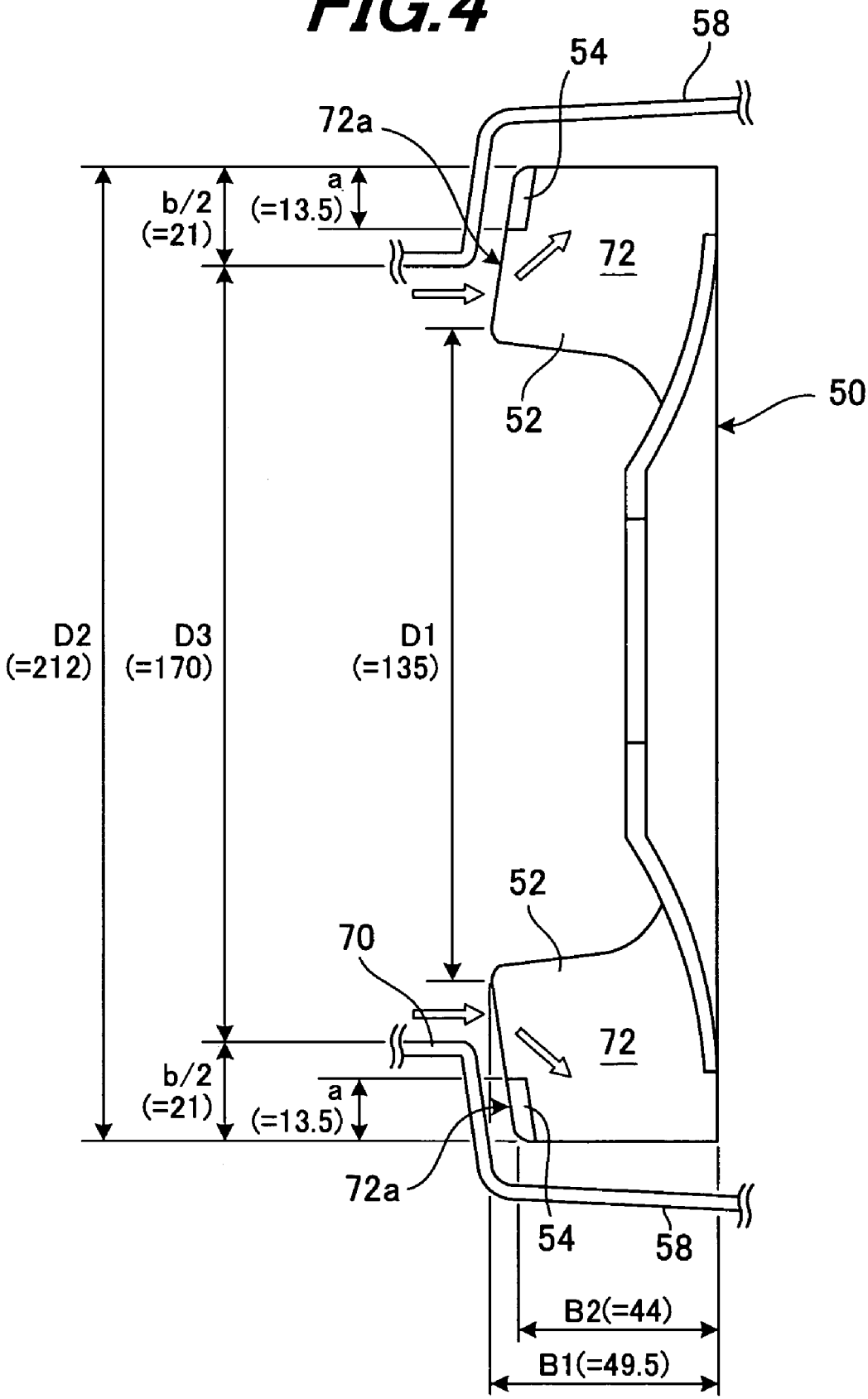
FIG. 4 is an explanatory diagram representing part of the impeller shown in FIG. 2.

FIG. 4 is an explanatory diagram representing part of the impeller 50 shown in FIG. 2. In FIG. 4, the inner diameter (inlet diameter) of the impeller 50 is designated D1 and the outer diameter thereof is designated D2.

Figure 5:
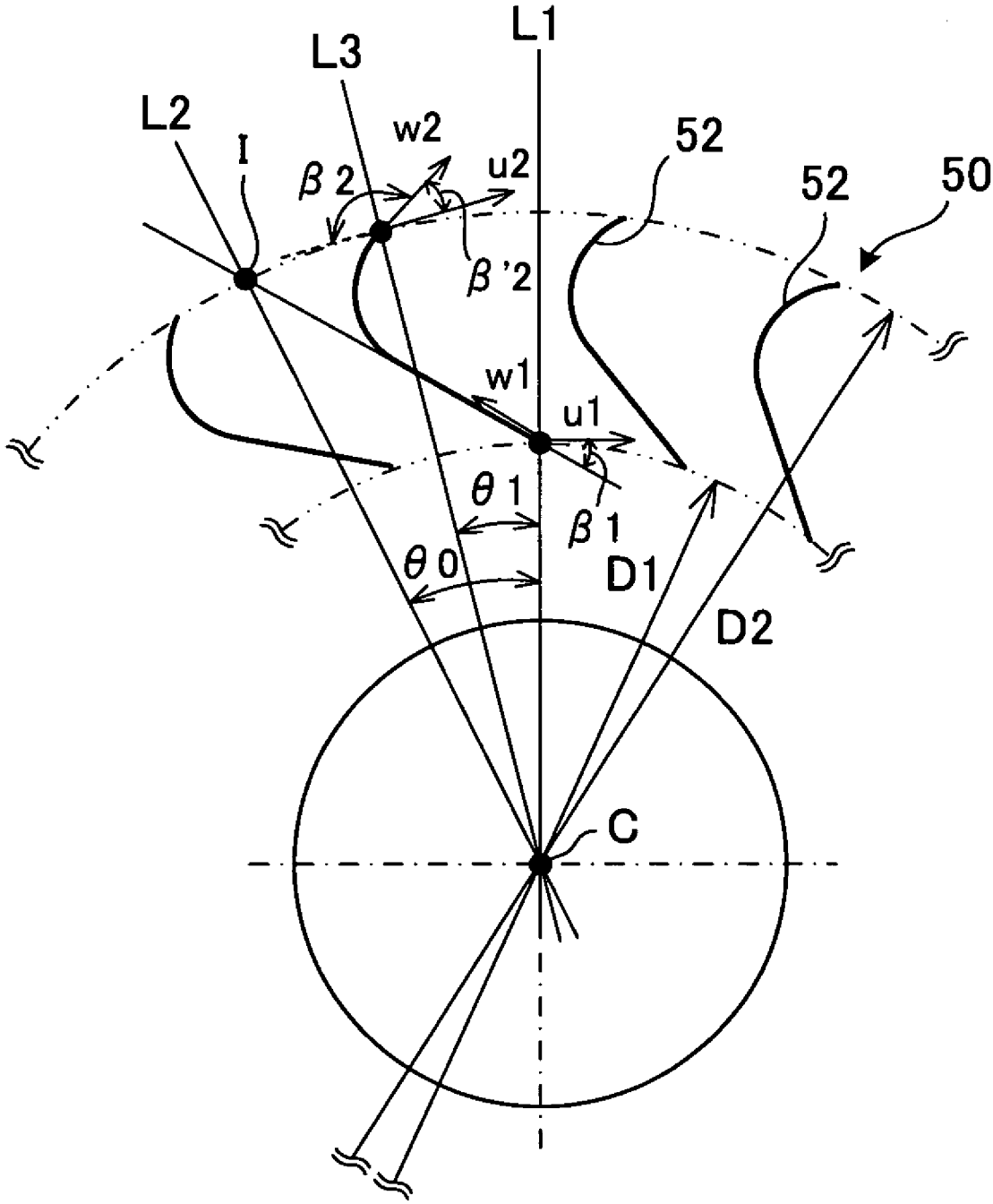
FIG. 5 is an explanatory diagram schematically representing part of the impeller shown in FIG. 4.
Figure 6:
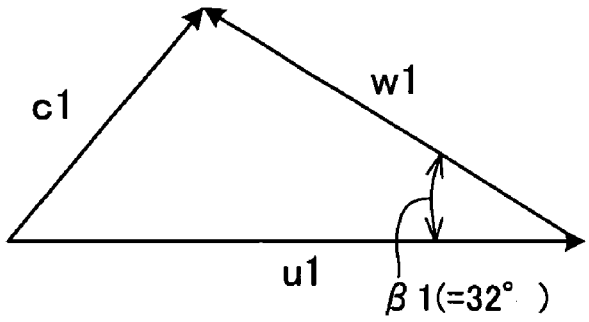
FIG. 6 is an explanatory diagram representing a velocity triangle on an inlet side of blades shown in FIG. 5.
Figure 7:
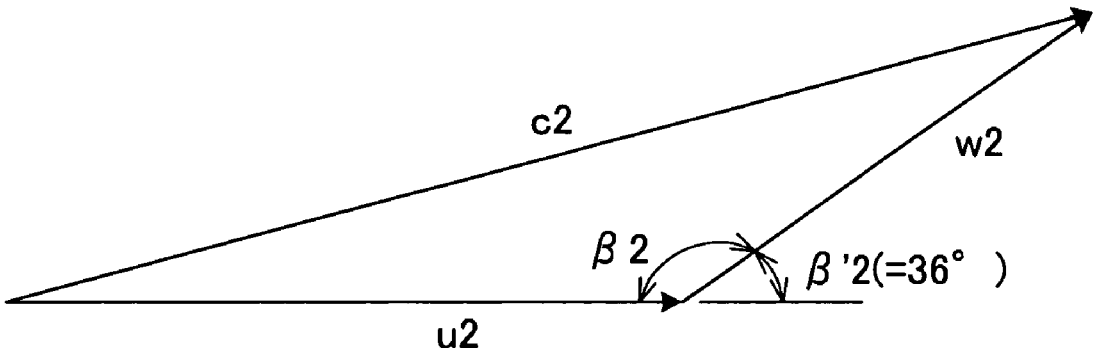
FIG. 7 is an explanatory diagram representing a speed triangle on an outlet side of the blades shown in FIG. 5.

FIG. 5 is an explanatory diagram schematically representing part of the impeller 50 shown in FIG. 4. FIG. 6 is an explanatory diagram representing the velocity triangle on the inlet side of the blades 52 shown in FIG. 5 and FIG. 7 is an explanatory diagram representing the speed triangle on the outlet side.

As shown in FIGS. 5 and 6, the relative velocity on the inlet side of the blades 52, i.e., inner diameter D1 side of the impeller 50 is called w1 and the inlet side peripheral velocity is called u1. The angle between the relative velocity w1 and the peripheral direction (direction of the peripheral velocity u1) (the inlet angle) is called β1. As shown in FIGS. 5 and 7, the relative velocity on the outlet side of the blades 52, i.e., outer diameter D2 side of the impeller 50 is called w2 and the outlet side peripheral velocity is called u2. The angle between the relative velocity w2 and the peripheral direction (direction of the peripheral velocity u2) (the outlet angle) is called β2. The value obtained by subtracting the outlet angle β2 from angle 180° is called angle β'2. The symbols c1 and c2 in FIGS. 6 and 7 designate the absolute velocity on the inlet side and the absolute velocity on the outlet side. The unit of velocity is m/s in all instances.

In the impeller of a multi-blade fan, the sum of the inlet angle β1 and the angle β'2 has generally been defined to be 90°. The inlet angle β1 has usually been set in the range of 46° to 51°, with 49° being the most common choice. The angle β'2 has usually been set in the range of 39° to 44°, with 41° being the most common choice.

Differently from this, in the impeller 50 of this embodiment, the sum of the inlet angle β1 and the angle β'2 is defined to be less than 80°. Specifically, the inlet angle β1 is defined as 32° and the angle β'2 is defined as 36°, giving a sum of 68°. The inventors discovered through experimentation that when the sum of the inlet angle β1 and the angle β'2 was made less than 80° (more preferably when β1 was made 32° and β'2 was made 36°), efficiency improved and air volume increased relative to the case where the sum was defined as 80° or greater.

The explanation of FIG. 5 will be continued. The straight line obtained by connecting the inlet of the blades 52 with the center of rotation C of the impeller 50 is called L1, the straight line obtained by connecting the intersection I of the circumference of the outlet side of the blades 52 (i.e., the circumference whose diameter is the outer diameter D2) and the direction of the inlet side relative velocity w1 with the center of rotation C is called L2, and the straight line obtained by connecting the outlet of the blades 52 with the center of rotation C is called L3. The angle between the straight line L1 and the straight line L2 is defined as θ0 and the angle between the straight line L1 and the straight line L3 is defined as angle θ1.

Experiments carried out by the inventors revealed the following problems regarding the setting of the angle θ1:

1) When the angle θ1 is less than 40% of the angle θ0, excessive air is captured between adjacent blades, giving rise to slipping that degrades efficiency.
2) When the angle θ1 is greater than 50% of the angle θ0, insufficient air is captured between adjacent blades, giving rise to a decrease in delivery pressure that lowers the air volume.

In this embodiment, therefore, the angle θ1 is given a value between 40% and 50% of the angle θ0. This makes it possible to effectively minimize reduction of air volume and degradation of efficiency. The best results were found to be obtained when the angle θ1 was given a value equal to 48% of the angle θ0.

The number Z of blades 52 will now be explained. The number Z of blades is determined or calculated in accordance with Eq. 1:

$$Z=\{2\pi \sin(\text{inlet angle } \beta 1+\text{angle } 90^\circ-\text{angle } \beta'2)/2)\}/\{\text{constant term } K\times 2.3 \log 10 (\text{impeller outer diameter } D2/\text{impeller inner diameter } D1)\} \quad \text{Eq. 1}$$

The constant term K has usually been given a value between 0.35 and 0.45. Differently from this, in this embodiment, the constant term K is given a value between 0.5 and 0.68, preferably 0.5. This reduces the number Z of blades by about 30% relative to that in the prior art (conventional) impeller.

As mentioned above regarding the problems to be overcome by the invention, reducing the number of blades reduces noise level but has the undesired effect of lowering air volume. In the multi-blade fan 10 according to this embodiment, however, air volume is to be increased by defining the inlet angle β1, angle β'2 and angle θ1 in the foregoing manner, so that the drop in air volume caused by reducing the number of blades can be offset. The inventors therefore modified the constant term K so as to determine the minimum number of blades Z capable of ensuring the air volume required for cooling the engine 12.

The outer diameter D2 and inner diameter D1 are given values that make their ratio (D1/D2) equal to between 0.57 and 0.64, preferably 0.64. Specifically, as shown in FIG. 4, the inner diameter D1 is made 135 mm and the outer diameter D2 is made 212 mm, making D1/D2 about 0.64. Further, the width of the blades 52 is set so that the inlet blades have a width B1 of 49.5 mm and the outlet blades have a width B2 of 44 mm.

When the above-defined inlet angle β1 (32°), angle β'2 (36°), outer diameter D2 (212 mm), inner diameter D1 (135 mm) and constant term K (0.5) are substituted into Eq. 1, the value of Z becomes 19. Since the impeller 50 performs rotational motion, the number of blades is desirably even. So the number of the blades 52 in this embodiment is made 18, the largest even number smaller than the calculated value of Z.

Figure 8:
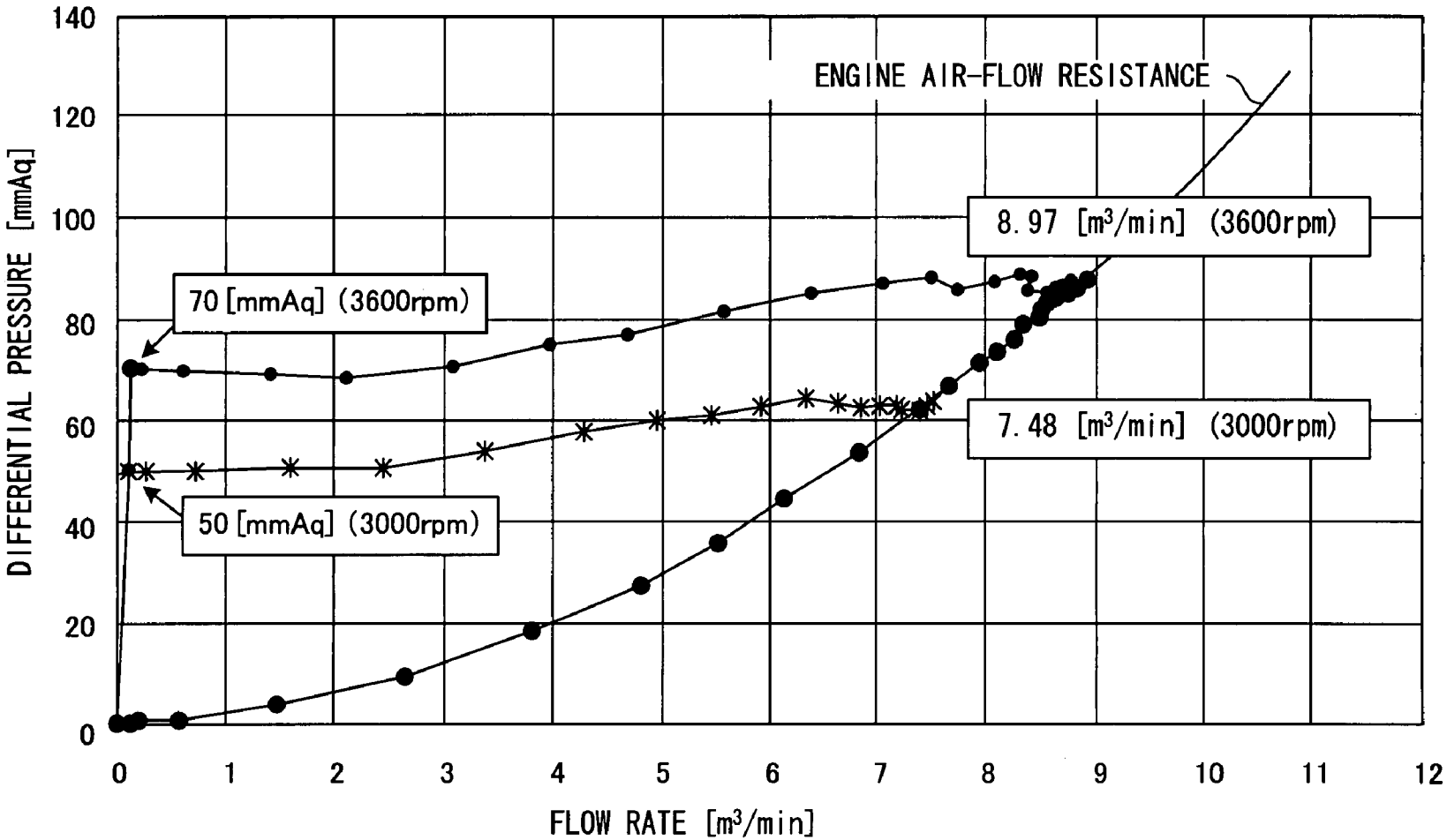
FIG. 8 is a graph showing air volume data measured for the multi-blade fan shown in FIG. 1.
Figure 11:
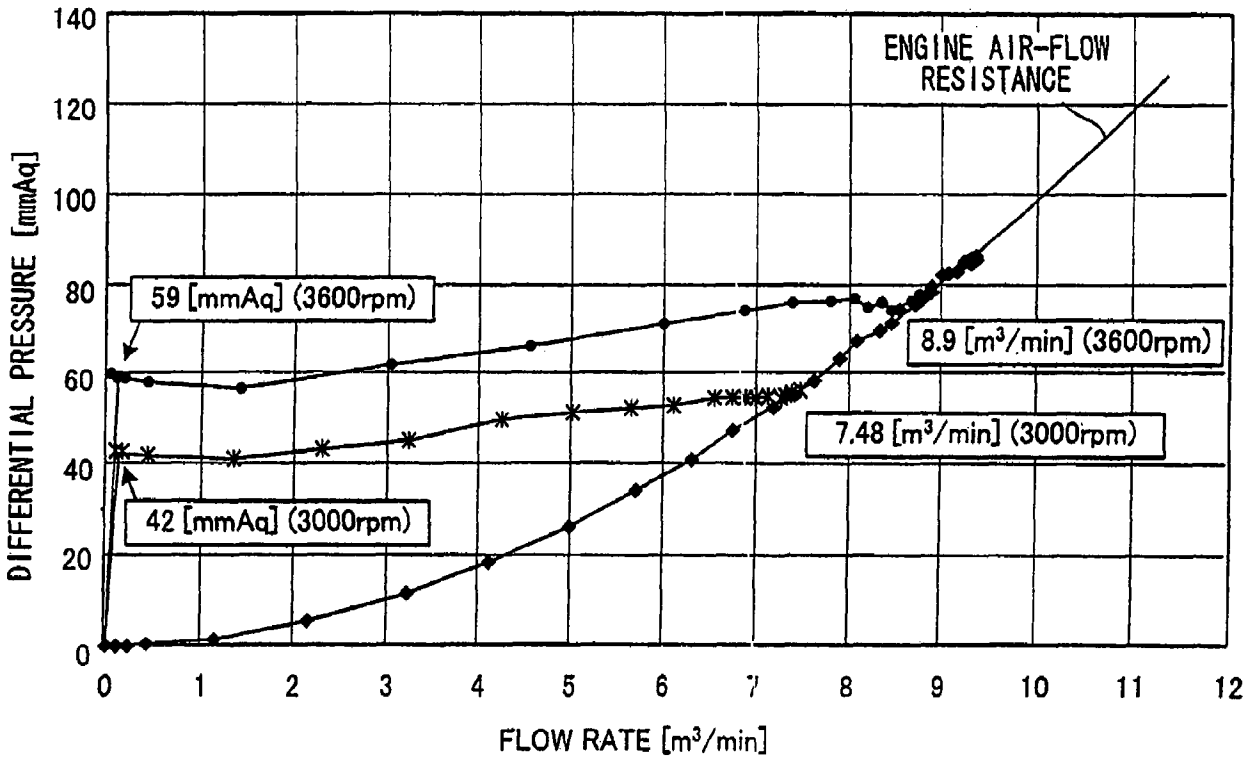
FIG. 11 is a graph similar to FIG. 8 showing air volume data measured for the prior art multi-blade fan.

FIG. 8 is a graph showing air volume data measured for the multi-blade fan 10 of this embodiment. FIG. 11 is a corresponding graph for a prior art multi-blade fan. The measured data shown in FIG. 11 was obtained using a multi-blade fan whose inlet angle β1, angle β'2, angle θ1 and constant term K (number Z of blades) were determined in accordance with conventional generally accepted guidelines but was the same as the multi-blade fan 10 in the width of the blades and other values.

As shown in FIGS. 8 and 11, no difference in air volume was observed between the multi-blade fan 10 according to this embodiment and the prior art multi-blade fan at an engine speed of either 3,000 rpm or 3,600 rpm. This shows that the multi-blade fan 10 achieved the air volume required for cooling the engine 12 despite being reduced in the number of its blades 52. The engine air-flow resistance in the graphs is the sum of the air-flow resistances (pressure losses) on the intake and delivery sides of the multi-blade fan.

Figure 9:
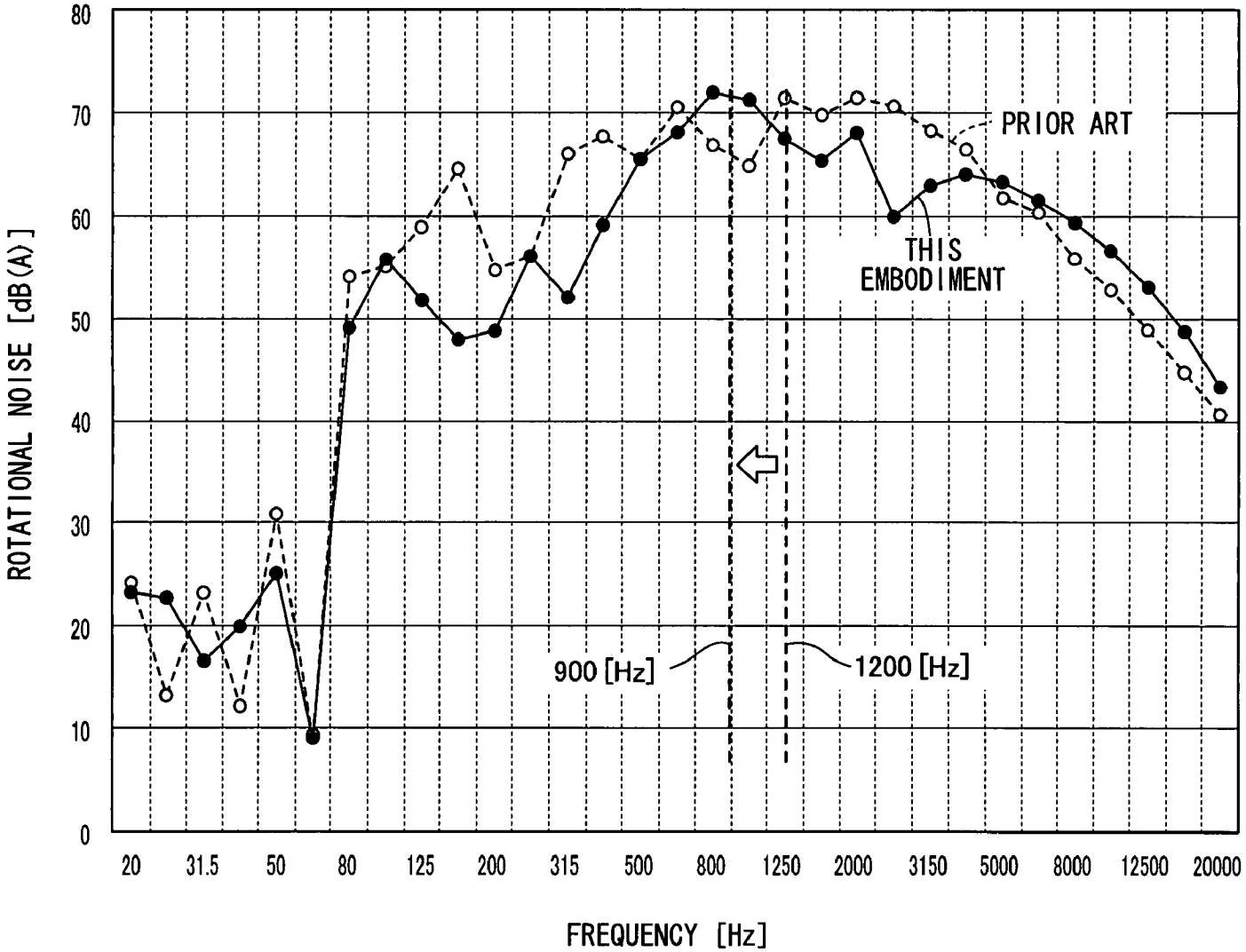
FIG. 9 is a graph showing a comparison of rotational noise between the multi-blade fan shown in FIG. 1 and a prior art (conventional) multi-blade fan.

FIG. 9 is a graph comparing rotational noise between the multi-blade fan 10 according to this embodiment and the prior art multi-blade fan. The data shown in FIG. 9 were obtained for the same multi-blade fan as that used to obtain the data of FIG. 11.

The inventors calculated overall values (sums of the sound pressures over the range of frequencies) from the curves of FIG. 9. The value obtained for the prior art multi-blade fan was 80 dB (A), while that obtained for the embodiment multi-blade fan 10 was 78 dB (A), an improvement of 2 dB (A).

The explanation of FIG. 4 will be resumed. The cover 58 is formed with a circular air intake port 70 having a diameter D3 of 170 mm. As can be seen from FIGS. 3 and 4, the annular roof 54 formed continuously along the blades 52 is configured so that at the space between each set of adjacent blades (designated 72 in FIGS. 3 and 4) it covers the part constituted by the surface 72*a* facing the air intake port 70, over a width a extending from the outlet of the blade 52 (outer diameter D2 side) in the direction of the inlet (inner diameter D1 side).

Where the difference obtained by subtracting the diameter D3 of the air intake port 70 from the outer diameter D2 is defined as b, the width a of the annular roof 54 is preferably defined as between 55% and 75%, more preferably 64%, of the quotient obtained by dividing the difference b by 2. These are the optimum values when the flow rate of the air blown from between adjacent blades is 5-10 m/s.

When, as in the foregoing, the outer diameter D2 is 212 mm and the diameter D3 of the air intake port 70 is 170 mm, b/2 is 21 mm. In this embodiment, the width a of the roof 54 is made 64% of this value, i.e., 13.5 mm.

Figure 12:
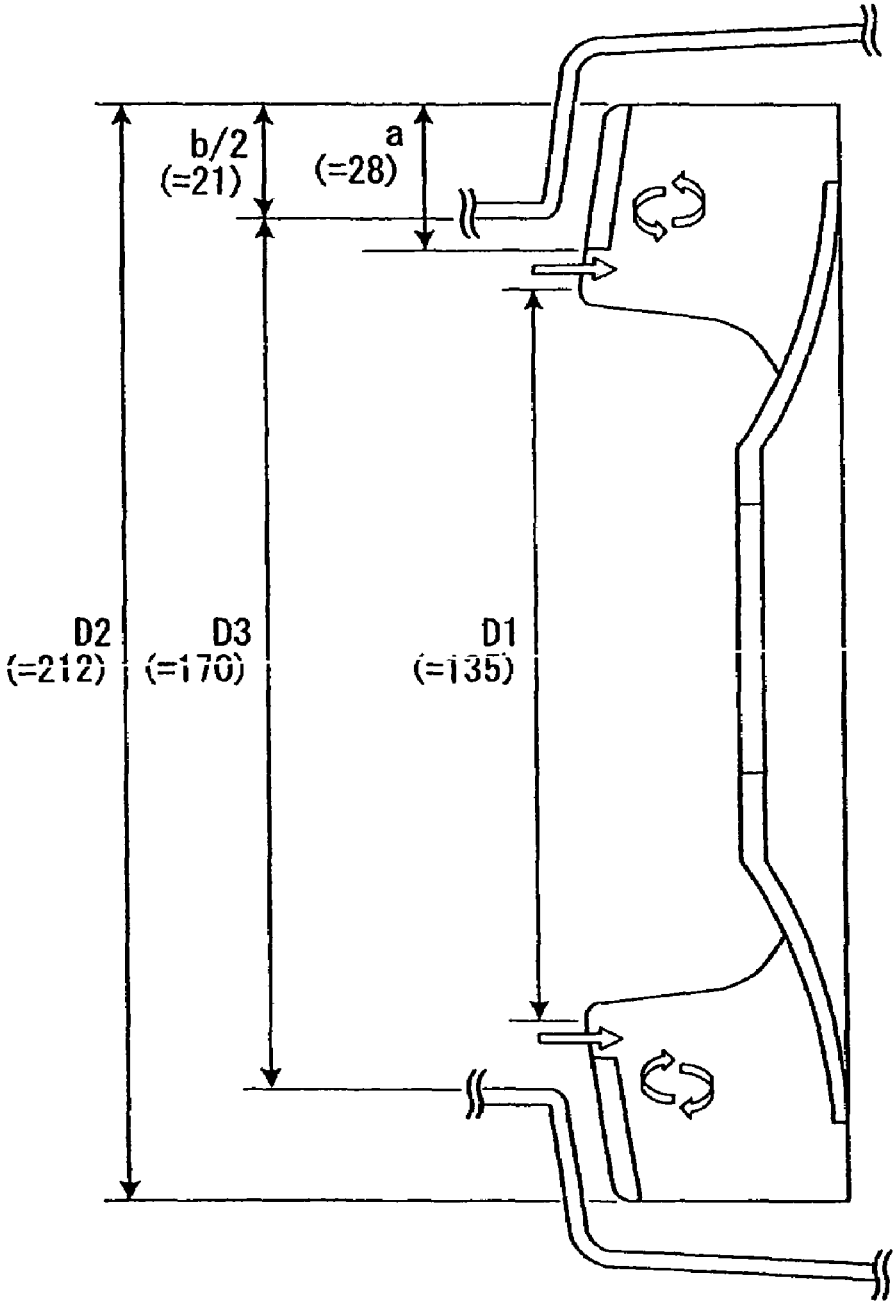
FIG. 12 is an explanatory diagram similar to FIG. 4 representing part of an impeller and cover of the prior art multi-blade fan.

FIG. 12 is an explanatory diagram similar to FIG. 4 representing part of the impeller and cover of a prior art multi-blade fan.

Although provision of a cover has been known to improve fan efficiency, the absence of a specific guideline regarding roof width has sometimes led to the provision of covers with detrimental effects. For example, as shown in FIG. 12, if the inner diameter of the roof is smaller than the diameter D3 of the intake port (i.e., if a>b/2; a being 28 mm in the example of FIG. 12), the drawn-in air generates vortices just after flowing to the inside of the roof and the vortices (turbulence) produce additional noise.

In contrast, in this embodiment the width a of the annular roof 54 is set at 55% to 75%, more preferably 64%, of the quotient obtained by dividing the difference b by 2, thereby making the inner diameter of the annular roof 54 larger than the diameter D3 of the intake port (i.e., a<b/2). The flow of the drawn-in air is therefore straightened to minimize occurrence of vortices.

Figure 10:
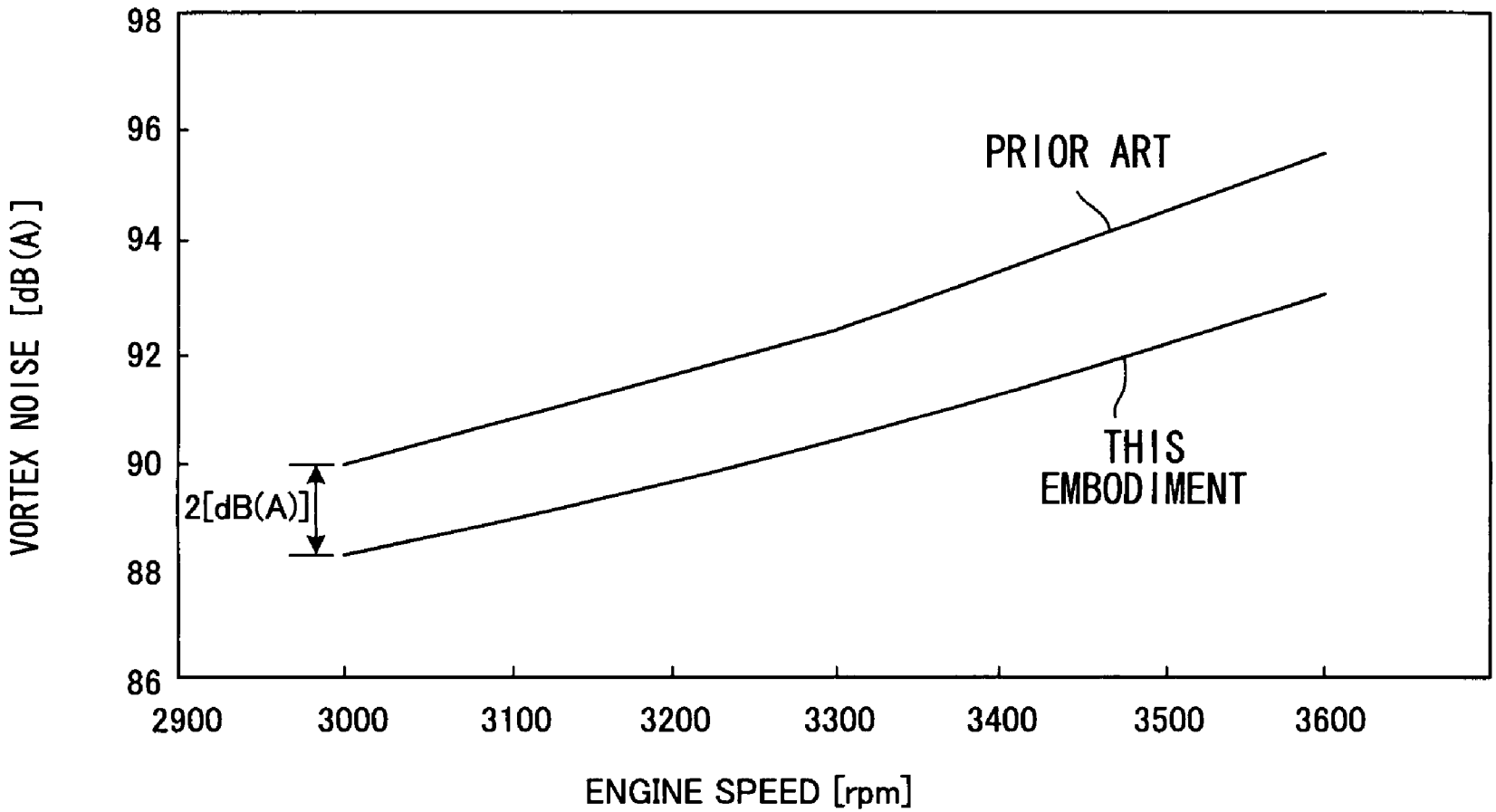
FIG. 10 is a graph showing a comparison of vortex noise between the multi-blade fan shown in FIG. 1 and the prior art multi-blade fan.

FIG. 10 is a graph showing a comparison of vortex noise between the multi-blade fan 10 according to this embodiment and the prior art multi-blade fan shown in FIG. 12. As shown in FIG. 10, the multi-blade fan 10 according to this embodiment achieved an approximate 2 dB (A) reduction in vortex noise relative to the prior art owing to the fact that the width a of the annular roof 54 was optimized to minimize vortex generation. No difference was observed between the measured air volumes of the multi-blade fan 10 and the multi-blade fan shown in FIG. 12.

Thus by defining the inlet angle β1 and the angle β'2 to make the sum thereof less than 80° (preferably defining β1 as 32° and β'2 as 36°), the multi-blade fan 10 according to this embodiment achieves greater air volume than in the case where the sum is made 80° or greater, where β1 is the angle between the relative velocity direction (w1 direction) and the peripheral direction (u1 direction) on the inlet side of the blades 52, β2 is the angle between the relative velocity direction (w2 direction) and the peripheral direction (u2 direction) on the outlet side of the blades 52, and β'2 is the difference obtained by subtracting β2 from 180°. The number of blades can therefore be reduced to realize lower noise level while still maintaining the same air volume as the prior art multi-blade fan.

In addition, when the angle θ1 is given a value that is between 40% and 50% (preferably 48%) of the angle θ0, the multi-blade fan 10 according to this embodiment simultaneously achieves a high level of air volume increase and a high level of noise level reduction as compared with those when other values are defined, θ0 being the angle between L1 and L2 and θ1 being the angle between L1 and L3, where L1 is the straight line obtained by connecting the inlet side of the blades 52 with the center of rotation C of the impeller 50, L2 is the straight line obtained by connecting the intersection I of the circumference of the outlet side of the blades 52 (i.e., the circumference whose diameter is the outer diameter D2) and the direction of the inlet side relative velocity w1 with the center of rotation C and L3 is the straight line obtained by connecting the outlet of the blades 52 with the center of rotation C.

Further, when the number Z of blades is determined in accordance with Eq. 1 and the constant term K used in Eq. 1 is given a value between 0.5 and 0.68 (preferably 0.5), the multi-blade fan 10 according to this embodiment achieves a reduction in noise level by decreasing the number of blades relative to the prior art multi-blade fan.

Moreover, in the case where the multi-blade fan 10 according to this embodiment is provided with the cover 58 enclosing the impeller 50, the air intake port 70 formed in the cover 58, and the annular roof 54 formed continuously along the blades 52 and configured so that at the space 72 between each set of adjacent blades it covers the part constituted by the surface 72*a* facing the air intake port 70 over a width a extending from the outlet in the direction of the inlet side, then when the width a is defined between 55% and 75% (preferably 64%) of the quotient obtained by dividing the difference b by 2, turbulence noise can be suppressed relative to that when another value is defined and a considerable air volume increase effect can be realized owing to the provision of the roof, where D2 is the outer diameter of the impeller 50, D3 is the diameter of the intake port and b is the difference obtained by subtracting diameter D3 from outer diameter D2.

The impeller efficiency nh of the multi-blade fan 10 is calculated from Eq. 2:

$$nh = \text{adiabatic head Had/theoretical head Hth} \quad \text{Eq. 2}$$

The adiabatic head Had of Eq. 2 is represented by Eq. 3:

$$\text{Had} = \{\kappa/(\kappa-1)\} \times (Pt1/\gamma) \times ((Pt1+Pt)/Pt)^{((\kappa-1)/\kappa)-1)} \quad \text{Eq. 3}$$

In Eq. 3, κ (air specific heat) is defined as 1.4 and Pt1 (absolute intake pressure) as 101,320 Pa. Pt (absolute discharge pressure) is the sum of the static pressure and dynamic pressure inside the cover 58 and is defined as the measured value of 552 Pa. γ (intake air specific weight) is defined as 1.13 in accordance with Eq. 4 below. In Eq. 4, g is gravitational acceleration and R is a constant (=29.27). ta is intake temperature (measured value) and is defined as 40° C.

$$\gamma = (Pt1/g)/(R \times (273+ta)) \quad \text{Eq. 4}$$

The theoretical head Hth of Eq. 2 is represented by Eq. 5:

$$Hth = (1/g) \times ((u2 \times c2u) - (u1 \times c1u)) \quad \text{Eq. 5}$$

In Eq. 5, u2 is the aforesaid outlet side peripheral velocity and u1 is the inlet side peripheral velocity. The value c2u is the circumferential direction component of the outlet side absolute velocity and c1u is the circumferential direction component of the inlet side absolute velocity. The values u2, c2u, u1 and c1u are calculated in accordance with Eqs. 6 to 9:

$$u2 = Ku \times \sqrt{(2 \times g \times \text{Had})} \quad \text{Eq. 6}$$

$$c2u = u2 - (cm2/\tan(90-\beta'2)) \quad \text{Eq. 7}$$

$$u1 = N \times \pi \times D1/60 \quad \text{Eq. 8}$$

$$c1u = u1 - (cm1/\tan \beta 1) \quad \text{Eq. 9}$$

Ku is a circumferential velocity coefficient defined as 1.07. cm2 is the meridian of the outlet side absolute velocity and cm1 is the meridian of the inlet side absolute velocity. The values are defined according to Eqs. 10 and 11. N is the speed of rotation and is defined as 3,000 rpm or 3,600 rpm.

$$cm1 = cm2 \times 1.1 \sim 1.24 \quad \text{Eq. 10}$$

$$cm2 = u2 \times 0.315 \quad \text{Eq. 11}$$

When the speed of rotation is 3,000 rpm, the adiabatic head Had and theoretical head Hth calculated in accordance with the foregoing equations are 49.8 m and 81 m. The impeller efficiency nh is therefore 61%. In view of the fact that 60% is considered a high efficiency for an ordinary multi-blade fan, the multi-blade fan 10 according to this embodiment can be considered to be very efficient.

The outer diameter D2 and inner diameter D1 of the impeller 50 are not limited to the specific values assigned to them in the foregoing description but can of course be appropriately decided in accordance with the purpose of the multi-blade fan and other factors.

Moreover the engine 12 is not limited to the purpose of driving an alternator as explained in the foregoing but can be used as a prime mover in various kinds of equipment.

Japanese Patent Application No. 2005-162891 filed on Jun. 2, 2005, is incorporated herein in its entirety.

While the invention has thus been shown and described with reference to specific embodiments, it should be noted that the invention is in no way limited to the details of the described arrangements; changes and modifications may be made without departing from the scope of the appended claims

What is claimed is:

1. A multi-blade fan having an impeller equipped with a plurality of blades attached to an air-cooled internal combustion engine to be rotated to blow air toward the engine to cool, comprising:

an inlet angle β1 defined to be an angle between a relative velocity direction and a peripheral direction on an inlet side of the blades, an outlet angle β2 defined to be an angle between the relative velocity direction and the peripheral direction on an outlet side of the blades; and an angle β'2 defined to be a difference obtained by subtracting the outlet angle β2 from 180°, wherein a sum of the inlet angle β1 and the angle β'2 is made less than 80°, and wherein an angle θ1 is given a value that is between 40% and 50% of an angle θ0, where the angle θ0 is an angle between L1 and L2; the angle θ1 is angle between L1 and L3; L1 is a straight line obtained by connecting the inlet side of the blades with a center of rotation of the impeller; L2 is a straight line obtained by connecting an intersection of a circumference of the outlet side of the blades and the direction of the inlet side relative velocity with the center of rotation of the impeller; and L3 is a straight line obtained by connecting the outlet side of the blades with the center of rotation of the impeller.

2. The multi-blade fan according to claim 1, wherein the angle θ1 is given a value that is 48% of the angle θ0.

3. A multi-blade fan having an impeller equipped with a plurality of blades attached to an air-cooled internal combustion engine to be rotated to blow air toward the engine to cool, comprising:

an inlet angle β1 defined to be an angle between a relative velocity direction and a peripheral direction on an inlet side of the blades, an outlet angle β2 defined to be an angle between the relative velocity direction and the peripheral direction on an outlet side of the blades; and an angle β'2 defined to be a difference obtained by subtracting the outlet angle β2 from 180°, wherein a sum of the inlet angle β1 and the angle β'2 is made less than 80°, and wherein number of blades (Z) is determined in accordance with an equation expressed by Z={2π sin (inlet angle β1+angle 90°−angleβ'2)/2)}/{constant term K×2.3 log 10 (impeller outer diameter D2/impeller inner diameter D1)}.

4. The multi-blade fan according to claim 3, wherein the constant term K is given a value between 0.5 and 0.68.

5. The multi-blade fan according to claim 4, wherein the constant term K is given a value 0.5.

6. A multi-blade fan having an impeller equipped with a plurality of blades attached to an air-cooled internal combustion engine to be rotated to blow air toward the engine to cool, comprising:

an inlet angle β1 defined to be an angle between a relative velocity direction and a peripheral direction on an inlet side of the blades, an outlet angle β2 defined to be an angle between the relative velocity direction and the peripheral direction on an outlet side of the blades;

an angle β'2 defined to be a difference obtained by subtracting the outlet angle β2 from 180°, a cover enclosing the impeller, an air intake port formed in the cover, and an annular roof formed continuously along the blades and configured so that at a space between each set of adjacent blades it covers a part constituted by a surface facing the air intake port over a width a extending from the outlet side in the direction of the inlet side, wherein a sum of the inlet angle β1 and the angle β'2 is made less than 80°, and wherein the width a is defined between 55% and 75% of a quotient obtained by dividing b by 2, where D2 is an outer diameter of the impeller, D3 is a diameter of the intake port and b is the difference obtained by subtracting diameter D3 from the outer diameter D2.

7. The multi-blade fan according to claim 6, wherein the width a is defined 64% of the quotient obtained by dividing b by 2.

* * * * *